US005385158A

United States Patent [19]

Owens, Jr.

[11] Patent Number: 5,385,158

[45] Date of Patent: * Jan. 31, 1995

[54] WRAPPER FOR SMOKING ARTICLE, SMOKING ARTICLE, AND METHOD OF MAKING SAME

[76] Inventor: William F. Owens, Jr., 12 Orchid Heights Dr., Pisgah Forest, N.C. 28768

[ * ] Notice: The portion of the term of this patent subsequent to Apr. 28, 2009 has been disclaimed.

[21] Appl. No.: 756,543

[22] Filed: Sep. 9, 1991

[51] Int. Cl.[6] ..... A24D 1/02

[52] U.S. Cl. ..... 131/365

[58] Field of Search ..... 131/365, 335

[56] References Cited

U.S. PATENT DOCUMENTS 3,744,496 7/1973 McCarty et al. .
4,231,377 11/1980 Cline et al. .
4,420,002 12/1983 Cline .
4,433,697 2/1984 Cline et al. .
4,450,847 5/1984 Owens .
4,881,557 11/1989 Martin .
5,107,864 4/1992 Owens, Jr. ..... 131/365

OTHER PUBLICATIONS

Leffingwell et al, "Tobacco Flavoring for Smoking Products," (R. J. Reynolds Tobacco Co. 1972), pp. 1, 11–14, 63 and 64.

*Primary Examiner*—V. Millin
*Assistant Examiner*—J. Doyle

[57] ABSTRACT

Stabilization and demobilization of volatile organic and volatile inorganic acids by acid adsorption onto activated carbon, which is then used in the manufacture of wrappers for smoking articles, provides improvements in sidestream smoke aroma, reduction in sidestream smoke irritation and improvements in subjective taste of the mainstream smoke.

27 Claims, No Drawings

WRAPPER FOR SMOKING ARTICLE, SMOKING ARTICLE, AND METHOD OF MAKING SAME

SUMMARY OF THE INVENTION

This invention relates to improved wrappers for smoking articles, the method of making such wrappers, and to smoking articles made from such wrappers.

A purpose of this invention is to provide improved subjective taste properties to smoking articles where the tobacco column is wrapped in reduced sidestream smoke cigarette papers.

Reduced sidestream smoke cigarette papers have good appearance and high opacity which, when fabricated into cigarettes and other smoking articles with suitable tobacco columns and filter systems, statically burn at acceptable rates and produce up to 75% less particulate sidestream smoke than do cigarettes and other smoking articles fabricated with conventional wrappers. Furthermore, desirable improvements in subjective properties of cigarettes and other smoking articles are accomplished by incorporating into the wrapper furnish activated carbon which has a volatile acid adsorbed onto the carbon. Adsorption of the acids onto the carbon prevents the acids from migrating and reacting with the basic fillers (i.e. magnesium hydroxide and/or calcium carbonate) which may also be present in the wrapper furnish. Therefore, when cigarettes or other smoking articles are produced with wrappers containing the carbon adsorbed acids, the acids are directly released, as determined by gas chromatographic/mass spectrometric analysis (GC/MS analysis), into both the mainstream smoke and sidestream smoke via a heat-release mechanism as the smoking article is consumed. The resulting acid-enhanced mainstream smoke taste is significantly improved, the sidestream smoke irritation is reduced, and the sidestream aroma is improved.

BACKGROUND OF THE INVENTION

The reduced cigarette sidestream smoke papers or wrappers, as described in U.S. Pat. Nos. 4,231,377 Cline et al.; 4,420,002 Cline; 4,433,697 Cline et al.; 4,450,847, Owens; and 4,881,447 Martin use high levels of basic fillers [$MgO/Mg(OH)_2$ and $CaCO_3$] to achieve reductions in the sidestream smoke of smoking articles. The filler concentrations in these papers are typically in the range of 14 to 60 grams per square meter, which is significantly higher than the 6 to 9 grams per square meter in regular cigarette paper. The high basis weights of these reduced sidestream smoke wrappers (typically 35 to 100 $g/m^2$) and the resultant thickness increase, along with the "heat sink" effect caused by the thermal breakdown of magnesium hydroxide (shown in equation 1 below), cause an increased condensation of the smoke on the inside surface of the paper and within the paper structure itself. This smoke normally would penetrate through regular cigarette paper and form the typical sidestream smoke plume observed with regular smoking articles.

Equation 1

$$Mg(OH)_2 \xrightarrow[350^\circ C.]{Heat} MgO + H_2O \quad \Delta H = +332 \text{ calories/gram}$$

The increased tar condensation on the inside surface of the cigarette paper and in the internal structure of the cigarette paper itself, along with the significantly higher level of basic fillers [$MgO/Mg(OH)_2$ and $CaCO_3$] in the reduced cigarette sidestream smoke papers, results in a greater reaction of acidic smoke components with the basic fillers in the reduced sidestream smoke papers versus regular cigarette papers. This reaction results in nonvolatile tar components being formed which are not revolatilized back into the mainstream smoke but are pyrolyzed to lower molecular weight smoke components.

Extensive subjective taste studies have shown the taste characteristics of smoking articles wrapped in reduced sidestream smoke papers to have objectional taste characteristics relative to regular smoking articles. Additional studies have also shown the pH of the mainstream smoke of tobacco columns wrapped in reduced sidestream smoke cigarette paper is higher than that of the same tobacco columns wrapped in regular cigarette paper. The subjective taste characteristics of cigarettes wrapped in reduced sidestream smoke cigarette paper are similar to that obtained when the pH of mainstream smoke of regular cigarettes is artificially increased.

PRIOR ART

U.S. Pat. No. 3,744,496, assigned to Olin Corporation, discloses a carbon-filled paper to wrap cigarettes and/or cigars, preferably used as an innerliner, with an outer wrap of regular cigarette paper or cigar wrapper.

U.S. patent application Ser. No. 656,497, Owens, reveals the use of activated carbon and/or flavored activated carbon as part of the furnish of reduced sidestream smoke wrappers for smoking articles. Treatment of reduced sidestream smoke wrappers for smoking articles with organic acids to reduce the basic character (pH) of the surface of the low sidestream paper is revealed in U.S. patent application Ser. No. 514,533, Owens, filed April 26, 1990. The acids disclosed in U.S. patent application Ser. No. 514,533, Owens, react with the basic fillers [$Mg(OH)_2$ and $CaCO_3$] of the paper to form non-volatile salts which do not produce the positive taste characteristics of the free acids when these treated papers are used to produce smoking articles which are subsequently smoked.

DETAILED DESCRIPTION OF THE INVENTION

It has been found that by adsorbing volatile organic acids and volatile inorganic acids onto activated carbon, which is subsequently used as part of the furnish of smoking article wrappers which may contain other fillers such as magnesium hydroxide and calcium carbonate, an enhancement in sidestream smoke aroma, a reduction in sidestream smoke irritation and an enhancement of the mainstream smoke taste characteristics are afforded.

The improved wrappers may be used as a single outer wrap or as an inner liner with regular smoking article wrappers as the outer wrap, or the improved wrapper may be used as both the inner and outer wrappers of smoking articles.

Also, by adsorbing the volatile acids onto the carbon, the acids are no longer free to volatilize and/or migrate to other parts of the smoking article during storage. As with U.S. patent application Ser. No. 656,497, Owens, filed Feb. 19, 1991 (activated carbon filled, low sidestream smoke paper), the acid-treated carbon gives a greater reduction in sidestream smoke (see Table I) than is obtained over magnesium hydroxide/calcium carbonate filled, reduced sidestream smoke wrappers, while producing a significant improvement in ash properties. The taste properties of the acid-treated carbon, reduced sidestream smoke wrappers are significantly improved over taste properties obtained in the teachings of U.S. patent application Ser. No. 656,497, Owens, filed Feb. 19, 1991 (activated carbon filled, low sidestream smoke paper). The resulting cigarette is distinctly light to dark grey in color, depending on the particle size and level of carbon in the paper.

The novel findings in this invention are the stabilization and improvements in sidestream smoke aroma, the reduction in sidestream smoke irritation, and the further improvement in subjective taste properties of cigarettes and other smoking articles wrapped in papers containing the acid-treated carbon.

| PARAMETERS OF THE INVENTION (All percentages based on the basis weight of the paper) | |
|---|---|
| Carbon content: | 2.0% to 60% |
| Preferred | 5.0% to 25% |
| Magnesium Hydroxide content: | 0.0% to 35% |
| Preferred | 0.0% to 20% |
| Calcium Carbonate content: | 0.0% to 40% |
| Preferred | 0.0% to 30% |
| Basis Weight: | 25 $gm/m^2$ to 100 $gm/m^2$ |
| Preferred | 35 $gm/m^2$ to 65 $gm/m^2$ |
| Porosity: | 1 to 100 Coresta |
| Preferred | 5 to 20 Coresta |
| Burning Chemical: | alkali metal salts of organic and inorganic acids selected from the group consisting of citric, malic, lactic, glycolic, tartaric, fumaric, maleic, malonic, glutaric, adipic, acetic, succinic, phosphoric, hydrochloric, and sulfuric |
| Burning Chemical Addition Rate: | 0.5% to 10.0% |
| Acids: | Volatile organic acids, such as acetic, propionic, butyric, isovaleric, valeric, beta methyl valeric, and volatile inorganic acids, such as phosphoric, sulfuric, and hydrochloric |
| Acid Addition Rate: | 0.01% to 5.0% |
| Preferred | 0.20% to 2.0% for organic acids<br>0.01% to 0.2% for inorganic acids |
| Sugar Addition: | 0.0% to 10% mono-, di-, tri- or poly-saccharides. |
| Flavorant: | Flavors adsorbed on carbon can be used for further enhancement of taste and aroma characteristics in combination with acid-treated carbon |
| Smoking Articles: | Cigarettes, cigars, and the like. |

TABLE I

Sidestream Smoke Reduction Properties of Cigarettes* Containing Acid Treated Activated Carbon

| Sheet Structure | Sidestream Tar Generation Rate | % Sidestream Reduction |
|---|---|---|
| Control - regular cigarette paper<br>25 $gm/m^2$, 30% $CaCO_3$<br>25 CORESTA Porosity | 2.2 mg/min | — |
| 45 $gm/m^2$, 40% $CaCO_3$<br>10 CORESTA Porosity | 1.36 mg/min | 38 |
| 45 $gm/m^2$, 11% acetic acid-treated activated carbon, 30% $CaCO_3$<br>10 CORESTA Porosity | 1.12 mg/min | 49 |
| 45 $gm/m^2$, 11% acetic acid-treated activated carbon, 10% gel $Mg(OH)_2$,<br>20% $CaCO_3$<br>10 CORESTA Porosity | 0.77 mg/min | 65 |

TABLE I-continued

Sidestream Smoke Reduction Properties of Cigarettes* Containing Acid Treated Activated Carbon

*Tobacco column: 100 mm Commercial Light 100's

TABLE II (All Percentages Based on the Basis Weight of the Paper)
Subjective Taste Evaluations of Cigarettes
Wrapped in Paper Containing Acid-Treated Activated Carbon Acid Type Acid-Treated Activated Carbon Activated Carbon - GX248 From: North American Carbon, Inc. 432 McCormick Boulevard Columbus, Ohio 43213

To 10 parts of activated carbon is added 1.0 part of the volatile acid with mixing. The carbon/acid mixture is left for a minimum of 24 hours in a closed container at room temperature before being used as a handsheet filler component.

Paper Composition Containing Acid-Treated Activate Carbon

| | |
|---|---|
| Acid-Treated Activated Carbon | 11% by weight |
| Calcium Carbonate | 20% by weight |
| Magnesium Hydroxide (as per U.S. Pat. No. 4,881,447) | 10% by weight |
| Refined Flax Fiber | 59% by weight |
| Porosity | 10 cm/min CORESTA |
| Basis Weight | 45 $gm/m^2$ |

Burning Chemical Treatment

Above base paper treated to contain 5.6% tri potassium citrate

Tobacco Column

Commercial Blended Lights 100's

| Acid | Taste | Aroma |
|---|---|---|
| None-Control | Harsh, lingering, chalky mouth coating/aftertaste | Strong harsh, cigar-like |
| Acetic | Very mild, no lingering after taste, or mouth coating | Mild, normal cigarette |
| Butyric | Very mild, no lingering aftertaste or mouth coating, fatty/buttery taste, slightly sweet | Mild, normal cigarette type low eye/nasal irritation |
| Iso valeric (3 methyl butyric) | Very mild, no lingering aftertaste or mouth coating, tobacco-like flavor notes, sweet notes | Mild, normal cigarette type low eye/nasal irritation sweet |
| Beta methyl valeric (3 methyl valeric) | very mild, no lingering aftertaste or mouth coating, strong tobacco-like flavor notes, sweet/floral flavor notes | Mild, normal cigarette type low eye/nasal irritation, floral/sweet |
| Levulinic | mild, no lingering after-taste or mouth coating, slight tobacco-like flavor notes | Mild, normal cigarette type |
| Phosphoric | Mild, bitter, slight bitter aftertaste | Mild, normal cigarette type low eye/nasal irritation |
| Citric[1] | Slight reduction in harshness, some remaining aftertaste and mouth coating | Strong, harsh, some cigar-like notes |
| Malic[1] | Slight reduction in harshness, some remaining aftertaste and | Strong, harsh, some cigar-like notes |

TABLE II-continued (All Percentages Based on the Basis Weight of the Paper)
Subjective Taste Evaluations of Cigarettes
Wrapped in Paper Containing Acid-Treated Activated Carbon

| | | | |
|---|---|---|---|
| | | mouth coating | |

Table II - Note
GC/Mass Spec analyses show free acid is released on heating from the acid-treated activated carbons when volatile acids, such as acetic, butyric, isovaleric, beta methyl valeric, and levulinic are used, whereas no detectable free acid is observed when non-volatile acids, such as citric and malic are used to treat the activated carbon. Data presented in Table II above shows the carbon treated with volatile acid when incorporated into a cigarette wrapper improves the mildness of mainstream smoke, while reducing the irritancy of the sidestream smoke. Non-volatile acids, such as citric and malic, show no significant improvements in these taste properties.
[1]To 10 parts GX248 Carbon was added a solution of 1 part acid, dissolved in 3 parts of water, and allowed to stand a minimum of 24 hours at room temperature before using as a handsheet filler.

TABLE III (All Percentages Based on the Basis Weight of the Paper)
Subjective Taste Evaluations of Cigarettes
Wrapped in Paper Containing Acid-Treated Activated Carbon Acid Type/Concentration Acid-Treated Activated Carbon Activated Carbon - GX248 From: North American Carbon, Inc. 432 McCormick Boulevard Columbus, Ohio 43213

Mix sufficient quantity of the volatile acid with activated carbon to yield the desired level of volatile acid in the paper, based on the paper being 10% activated carbon. The carbon/acid mixture is left for a minimum of 24 hours in a closed container at room temperature before being used as a handsheet filler component.

Paper Composition Containing Acid-Treated Activate Carbon

| | |
|---|---|
| Activated Carbon | 10% |
| Volatile acid | as required |
| Calcium Carbonate | 20% |
| Magnesium Hydroxide (as per U.S. Pat. No. 4,881,447) | 10% |
| Refined Flax Fiber | remaining % |
| Porosity | 10 cm/min CORESTA |
| Basis Weight | 45 gm/m$^2$ |

Burning Chemical Treatment

Above base paper treated to contain 5.6% tri potassium citrate.

Tobacco Column

Commercial Blended Lights 100's

| Acid | % in Paper | Taste | Aroma |
|---|---|---|---|
| None-control | 0.0 | Harsh, lingering, chalky aftertaste, mouth coating | Strong, harsh, cigar-like |
| Acetic | 0.01 | Reduced harshness, slight mouth coating | Strong, harsh, cigar-like |
| | 0.1 | Mild, no aftertaste or mouth coating | Normal cigarette |
| | 1.0 | Very Mild, no lingering aftertaste or mouth coating | Mild, normal cigarette |
| | 2.0 | Very mild, slightly bitter, no aftertaste or mouth coating | Very mild, reduced eye/nasal irritation |
| | 5.0 | Bitter, very mild, slight bitter aftertaste | Very mild, reduced eye/nasal irritation |
| Beta methyl valeric (3 methy valeric) | 0.02 | Greatly reduced harshness, no aftertaste, no mouth coating | Normal cigarette |
| | 0.05 | Mild, no aftertaste or mouth coating, enhanced tobacco taste | Normal cigarette |
| | 0.1 | Very mild, no aftertaste or mouth coating, enhanced tobacco taste | Mild, normal cigarette |
| | 0.5 | Very mild, no aftertaste or mouth coating, greatly enhanced tobacco taste | Mild, reduced eye/nasal irritation |
| | 1.0 | Very mild, no lingering aftertaste or mouth coating-strong tobacco-like flavor notes, sweet/floral flavor notes | Mild, normal cigarette type, low eye/nasal irritation, floral/sweet |
| | 2.0 | Very mild, slightly bitter, no lingering aftertaste or mouth coating, strong tobacco-like flavor notes, sweet/floral flavor notes | Mild, normal cigarette type, low eye/nasal irritation, floral/sweet |
| Phos-phoric | 0.01 | Mild, greatly reduced aftertaste and mouth coating | Normal cigarette, reduced eye/nasal irritation |
| | 0.1 | Very mild, no aftertaste or mouth coating | Normal cigarette, reduced eye/nasal irritation |
| | 1.0 | Mild, bitter, slight bitter aftertaste | Mild, normal cigarette type, low eye/nasal irritation |

Data presented in Table III above shows the level of acid treatment of the carbon can greatly impact the subjective taste properties of the mainstream and sidestream smoke. Carbon treatment to give levels of acid in the sheet as low as .01% to .1% can be very effective in achieving significant improvements in mainstream taste and sidestream aroma.

I claim:

1. A wrapper for smoking articles comprising a cellulosic fiber sheet containing inorganic fillers and activated carbon, the activated carbon having adsorbed thereon volatile organic acids prior to its incorporation into the cellulosic fiber sheet so that said volatile acids are no longer free to migrate to other parts of a smoking article during storage.

2. A wrapper for smoking articles comprising a cellulosic fiber sheet containing inorganic fillers and activated carbon, the activated carbon having adsorbed thereon volatile inorganic acids prior to its incorporation into the cellulosic fiber sheet so that said volatile acids are no longer free to migrate to other parts of a smoking article during storage.

3. The wrapper, as defined in claim 1, having an acid addition rate of 0.01% to 5.0%, based on the basis weight of the fiber sheet.

4. The wrapper, as defined in claim 1, having an acid addition rate of 0.20% to 2.0%, based on the basis weight of the fiber sheet.

5. The wrapper, as defined in claim 2, having an acid addition rate of 0.01% to 5.0%, based on the basis weight of the fiber sheet.

6. The wrapper, as defined in claim 2, having an acid addition rate of 0.01% to 0.2% based on the basis weight of the fiber sheet.

7. The wrapper, as defined in claims 1, 2, 3, 4, 5, or 6, wherein the activated carbon content is from about 2.0% to 60%, based on the basis weight of the fiber sheet.

8. The wrapper, as defined in claims 1, 2, 3, 4, 5, or 6, wherein the activated carbon content is from about 5.0% to 25%, based on the basis weight of the fiber sheet.

9. A smoking article, comprising a cellulosic fiber sheet containing inorganic fillers and activated carbon, the activated carbon having adsorbed thereon volatile organic acids prior to its incorporation into the cellulosic fiber sheet so that said volatile acids are no longer free to migrate to other parts of the smoking article during storage, wrapped about a tobacco charge.

10. A smoking article, comprising a cellulosic fiber sheet containing inorganic fillers and activated carbon, the activated carbon having adsorbed thereon volatile inorganic acids prior to its incorporation into the cellulosic fiber sheet so that said volatile acids are no longer free to migrate to other parts of the smoking article during storage, wrapped about a tobacco charge.

11. The smoking article, as defined in claim 9, having an acid addition rate of 0.01% to 5.0% based on the basis weight of the fiber sheet.

12. The smoking article, as defined in claim 9, having an acid addition rate of 0.20% to 2.0% based on the basis weight of the fiber sheet.

13. The smoking article, as defined in claim 10, having an acid addition rate of 0.1% to 5.0%, based on the basis weight of the fiber sheet.

14. The smoking article, as defined in claim 10, having an acid addition rate of 0.01% to 0.2%, based on the basis weight of the fiber sheet.

15. The smoking article, as defined in claims 9, 10, 11, 12, 13, or 14, wherein the activated carbon content is from about 2.0% to 60% based on the basis weight of the fiber sheet.

16. The smoking article, as defined in claims 9, 10, 11, 12, 13, or 14, wherein the activated carbon content is from about 5.0% to 25%, based on the basis weight of the fiber sheet.

17. A method for reducing the visible sidestream smoke and subjective taste characteristics of a smoking article, comprising wrapping the tobacco charge in a combustible cellulosic sheet containing inorganic fillers and activated carbon and adsorbing on the carbon a volatile organic acid prior to its incorporation into the cellulosic sheet so that said volatile acid is no longer free to migrate to other parts of the smoking article during storage.

18. A method for reducing the visible sidestream smoke and subjective taste characteristics of a smoking article, comprising wrapping the tobacco charge in a combustible cellulosic sheet containing inorganic fillers and activated carbon and adsorbing on the carbon a volatile inorganic acid prior to its incorporation into the cellulosic sheet so that said volatile acid is no longer free to migrate to other parts of the smoking article during storage.

19. The method, as defined in claim 17, having an acid addition rate of 0.01% to 5.0%, based on the basis weight of the fiber sheet.

20. The method, as defined in claim 17, having an acid addition rate of 0.20% to 2.0% based on the basis weight of the fiber sheet.

21. The method, as defined in claim 18, having an acid addition rate of 0.01% to 5.0% based on the basis weight of the fiber sheet.

22. The method, as defined in claim 18, having an acid addition rate of 0.01% to 0.2% based on the basis weight of the fiber sheet.

23. The method, as defined in claims 17, 18, 19, 20, 21 or 22, wherein the activated carbon content is from about 2.0% to 60%, based on the basis weight of the fiber sheet.

24. The method, as defined in claims 17, 18, 19, 20, 21 or 22, wherein the activated carbon content is from about 5.0% to 25% based on the basis weight of the fiber sheet.

25. The smoking article, as defined in claim 10, wherein the treated fiber sheet comprises an inner wrapper for said tobacco charge.

26. The smoking article, as defined in claim 10, wherein the treated fiber sheet comprises an outer wrapper for said tobacco charge.

27. The smoking article, as defined in claim 10, wherein the treated fiber sheet comprises both an inner and outer wrapper for said tobacco charge.

* * * * *

UNITED STATES PATENT AND TRADEMARK OFFICE

CERTIFICATE OF CORRECTION

PATENT NO. : 5,385,158

DATED : January 31, 1995

INVENTOR(S) : William F. OWENS, JR.

It is certified that error appears in the above-identified patent and that said Letters Patent is hereby corrected as shown below:

On the title page in column 1, after the information in "[76] Inventor" please include assignee data as follows:

-- P.H. Glatfelter Company, Spring Grove, Pennsylvania --

On the title page in column 2, after "Assistant Examiner — J. Doyle" please include the following:

-- Attorney, Agent, or Firm — Kerkam, Stowell, Kondracki & Clarke --

Signed and Sealed this

Eleventh Day of April, 1995

Bruce Lehman

*Attest:*

BRUCE LEHMAN

*Attesting Officer*

*Commissioner of Patents and Trademarks*